US005707250A

United States Patent [19]

Smithson

[11] Patent Number: 5,707,250

[45] Date of Patent: Jan. 13, 1998

[54] APPARATUS AND METHOD FOR STORAGE BATTERY CABLE CONNECTOR

[76] Inventor: Herbert L. Smithson, 8053 11th Ave. NW., Seattle, Wash. 98117

[21] Appl. No.: 573,502

[22] Filed: Dec. 15, 1995

[51] Int. Cl.[6] ..... H01R 11/00

[52] U.S. Cl. ..... 439/504; 439/348

[58] Field of Search ..... 439/348, 503, 439/504, 506, 623, 624

[56] References Cited

U.S. PATENT DOCUMENTS

| | | | |
|---|---|---|---|
| 3,478,306 | 11/1969 | McCray . | |
| 3,536,867 | 10/1970 | Lastinger et al. | 200/161 |
| 3,830,331 | 8/1974 | Piazza | 180/103 |
| 4,042,759 | 8/1977 | Cella | 429/121 |
| 4,195,897 | 4/1980 | Plevjak . | |
| 4,564,569 | 1/1986 | Pechal | 439/121 |
| 4,824,386 | 4/1989 | Souders | 439/348 X |
| 4,846,714 | 7/1989 | Welsby et al. | 439/348 OR |
| 5,066,905 | 11/1991 | Betton et al. | 439/504 X |
| 5,114,361 | 5/1992 | Houtteman | 439/348 OR |
| 5,269,709 | 12/1993 | Eriksson | 439/772 |
| 5,281,162 | 1/1994 | Ursich | 439/348 OR |

*Primary Examiner*—P. Austin Bradley
*Assistant Examiner*—Daniel Wittels
*Attorney, Agent, or Firm*—Gregory W. Hauth

[57] ABSTRACT

A latchable quick disconnect battery cable is presented to provide a means for an operator to manually disconnect and de-energize a battery from a vehicle's electrical circuit in the event of an accident, emergency or for maintenance. Re-energization of the electrical circuit is also accomplished by manual reconnection of said cable connectors.

4 Claims, 2 Drawing Sheets

APPARATUS AND METHOD FOR STORAGE BATTERY CABLE CONNECTOR

FIELD OF THE INVENTION

This invention relates to an automotive or marine storage battery connecting cable which includes a manually operated quick disconnect capability.

BACKGROUND OF THE INVENTION

A need exists for quick electrical disconnection of the primary battery circuit of a vehicle's storage battery. Quick disconnection of a conductor cable from a battery is needed in the event of an emergency that might occur in an automobile, powered boat and the like to prevent ignition of fuel from a broken fuel line or other sources of leaks and spills that may cause a fire such as may occur following a collision. In the worst case, fatalities and other injuries can occur in car accidents due to the vehicle catching fire either as a result of an electrical fire or due to sparks or hot wires which can then ignite flammable liquids (such as gasoline). Quick disconnection is also useful to prevent fires from restarting. Finally, quick disconnection also provides an easy method to de-energize electrical circuits for maintenance purposes. Hence, a need exists to quickly, easily and completely de-energize the electrical system of an automobile, power boat, or other such vehicle. The disconnection means should be reliable yet simple to operate and should be inexpensive to install. In addition, the system should be manually operated such that the discretion to cause disconnection is left with the operator or other attendant.

Other battery disconnection apparatus are disclosed by the prior art. U.S. Pat. No. 3,536,867 to Lastinger et al. discloses a Quick Disconnect Battery Apparatus. However, the device disclosed therein is intended for operation from within the cockpit of the automobile or vehicle containing the device, and subsequently, the device has a relatively complex design and many parts. U.S. Pat. Nos. 3,830,331 to Piazza and 4,195,897 to Plevjak describe Collision Activated, Automatic Electricity Disconnectors for Vehicles. These devices operate automatically in the event of a collision or other sudden impact; the invention disclosed herein is specifically intended as a manually operated device to allow the vehicle's operator or others the discretion as to whether electrical disconnection is necessary, and to maintain simplicity of design, construction and installation. Other prior art devices are disclosed which describe apparatus for easily engaging or disengaging cable clamps to battery terminals such as U.S. Pat. No. 3,478,306 to McCray and U.S. Pat. No. 4,656,569. However, the McCray device serves as a means to provide easy mechanical and electrical disconnection from the battery terminal and employs relatively complex design, whereas the present invention is intended as a means for a user to easily and quickly disconnect and de-energize a vehicle's electrical system from the storage battery. Moreover, disconnection devices at the battery terminal allow for the opportunity for corrosion of the disconnect device due to the device's proximity to active battery acids which results in high resistance at several points of electrical contact. These points of high resistance are all additive in series, resulting in substantial voltage drops and diminished reliability. Proximity to the battery terminal is also disadvantageous due to the hazard of hydrogen gas explosion from the battery vents, and due to space restrictions caused by the presence of such items as a battery cover, hold-down brackets, engine hood and other related accessories. Finally, constant removal and installation of devices on the battery terminal can cause undue wear of the terminal, thereby deteriorating both the mechanical and electrical soundness of the connection. Thus, the present invention overcomes disadvantages of prior art devices which depend on disconnecting the cable at the connection terminal of the storage battery.

OBJECTS AND ADVANTAGES

Therefore, it is a principal object of the present invention to provide a battery cable connector which can be easily installed in any vehicle, without the need to drill holes or provide other attachments to the vehicle. It is a further object of the present invention to provide a reliable, secure electrical connection which can be quickly and easily disconnected by an operator. It is a further object of the present invention to provide a battery cable that can be easily and quickly reconnected by an operator to restore the broken electrical circuit. Yet another object of the present invention is to use a minimum number of parts so as to maintain simplicity and low manufacturing cost. A final object of the device is to be relatively free from corrosion by constructing the device couplers of a non-corrosive electrically conductive material and by permitting a relatively remote location of the device from the immediate presence of the battery's corrosive fluids and gases.

REFERENCE NUMERALS IN DRAWINGS

Figure 1:
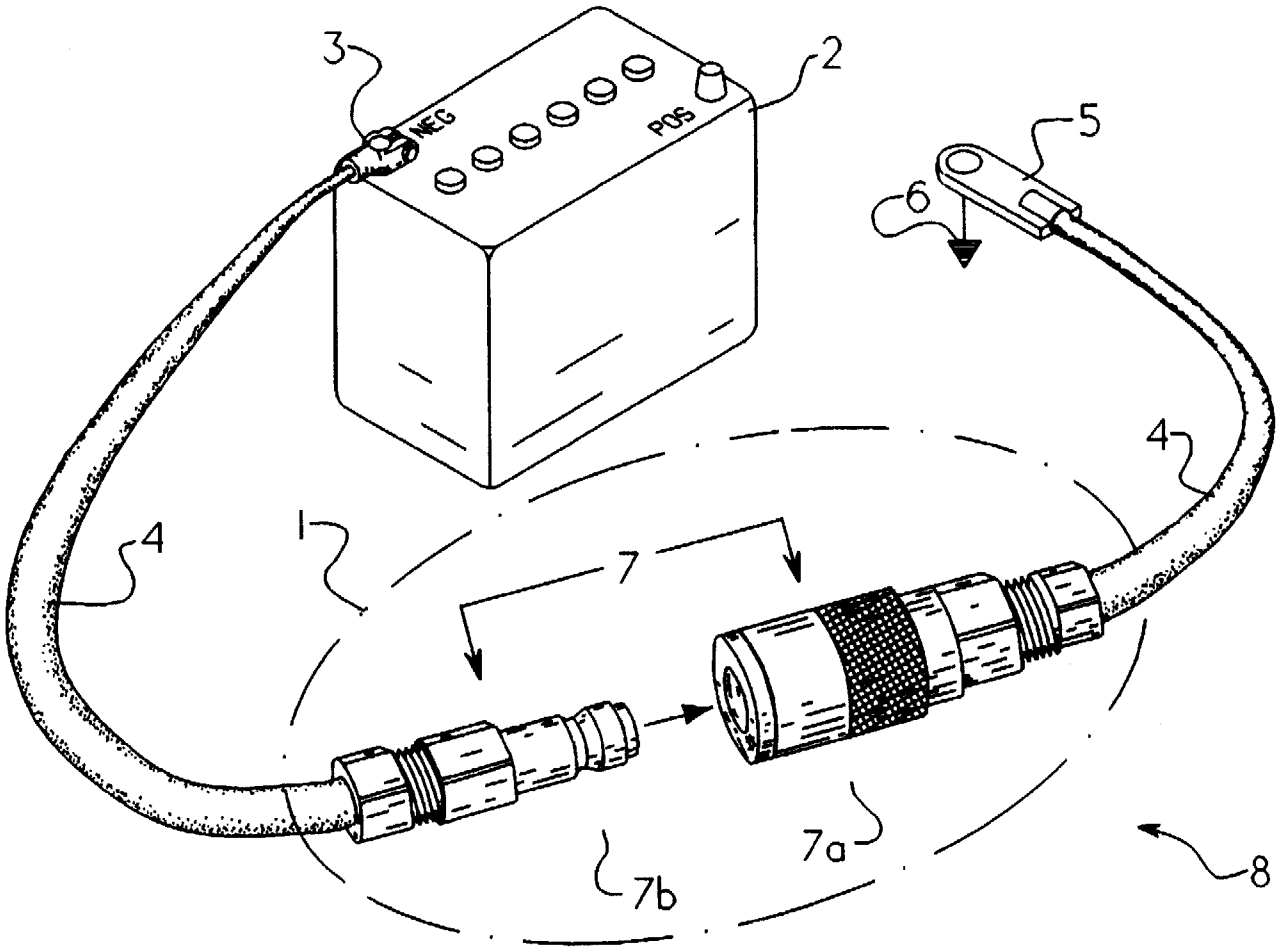
FIG. 1—an isometric view showing the connection of the present invention from a vehicle storage battery to chassis ground, and having an internal coupler section in the open (disabled) position. The dashed ellipse 1 indicates the more detailed area shown in FIG. 2.

1. Dashed ellipse indicated in more detailed area shown in FIG. 2
2. Storage Battery
3. Battery Terminal
4. Conducting Cable
5. Cable Terminal
6. Electrical Ground
7. Connector
7*a*. Female Coupler
7*b*. Male Coupler
8. Quick Disconnect Cable
11. Knurled ring
12. Arrow (direction indicator)
12*a* Motion Limit Stop
13. Flange
14. Groove
15. Male bushing
16. Female bushing
17. Male connecting point
18. Female connecting point
19. Internal Latch
20. Spring 21. Knurled ring Spring stop 22. Coupler spring stop

DETAILED DESCRIPTION OF PREFERRED EMBODIMENT

Construction.

FIG. 1 provides an isometric view showing the present invention comprising a Quick Disconnect Cable 8. Quick Disconnect Cable 8 (if optionally fully insulated) may be located on either the positive or negative conductor terminals of storage battery 2, or may be located on both positive and negative conductor terminals. Preferably, Quick Disconnect Cable 8 is located on at least the negative terminal, since disconnection of the battery from ground provides the safest means to de-energize the storage battery from a vehicle's circuit.

Quick Disconnect Cable 8 shown in FIG. 1 consists Connector 7 in combination with Conducting Cable 4 wherein Conducting Cable 4 terminates at a first end in Battery Terminal 3 and at a second end at Cable Terminal 5, which is further shown as electrically connected to Ground 6. Shown within ellipse 1 of FIG. 1, Connector 7 further comprises Female Coupler 7*a* and Male Coupler 7*b*. Components within Ellipse 1 are shown in greater detail in FIG. 2. Electrically, Connector 7 functions as a circuit breaker, as it permits continuous conduction through Cable 4 when Female Coupler 7*a* is joined with Male Coupler 7*b*, and Connector 7 serves to break the circuit when Female Coupler 7*a* and Male Coupler 7*b* are separated. Connector 7 should be located along the length of Cable 4 such that it is easily accessible to a user wishing to operate Connector 7 to make or break the connection, as described further herein below. An existing Cable 4 may be manufactured to create a Quick Disconnect Cable of the present invention by splicing into, or otherwise inserting, Connector 7 anywhere along Conducting Cable 4 between Battery Terminal 3 and Cable Terminal 5.

Figure 2:
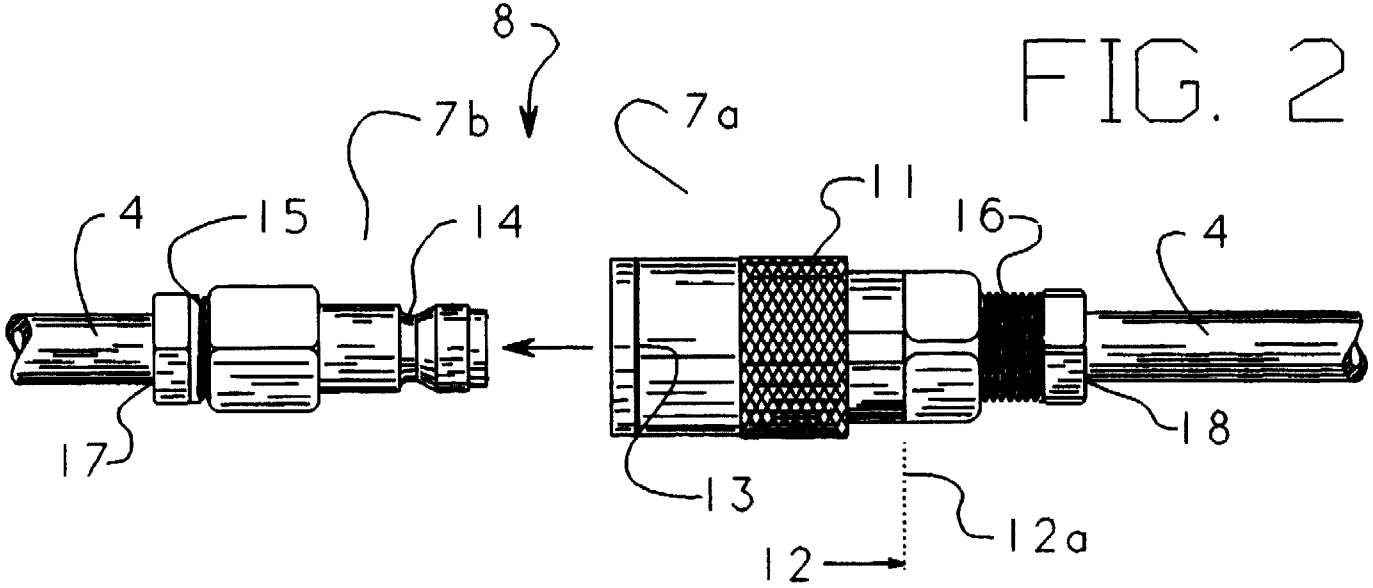
FIG. 2—Detailed view of the general cylindrical coupler of the present invention in the disengaged (disconnected) position.
Figure 3:
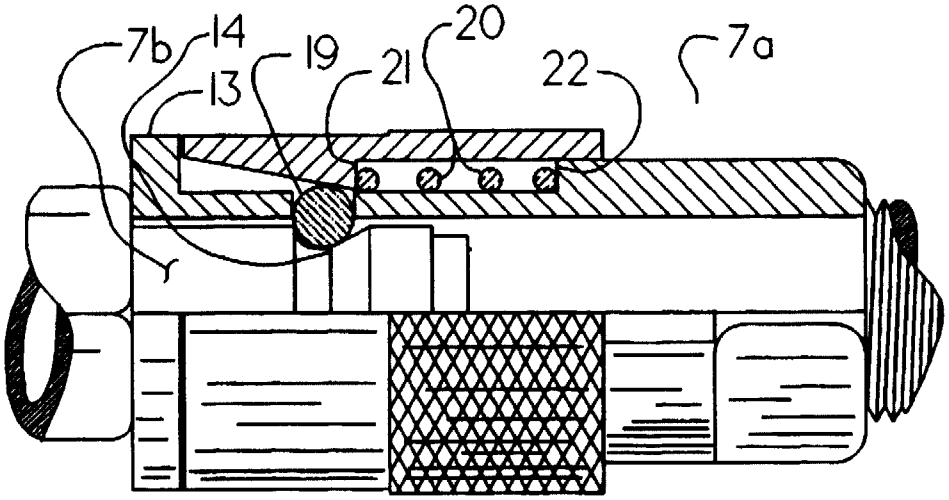
FIG. 3—Cut-away side view of the latching mechanism of the coupler shown in the same orientation as the coupler of FIG. 2.

FIG. 2 is a more detailed view of Connector 7, and shows Connector 7 in the disengaged position. In the preferred embodiment, Female Coupler 7*a* and Male Coupler 7*b* use a latch mechanism to ensure a good mechanical and electrical connection is made. Preferably, Female Coupler 7*a* and Male Coupler 7*b* consist of pneumatic couplers commonly available for pneumatic tools. Such male and female pneumatic couplers are available from Milton Industries, Inc., Chicago, Ill. The pneumatic couplers are readily adapted for electrical purposes since each end of Conducting Cable 4 may be readily fused, soldered, crimped or otherwise joined into Male bushing 15 and Female bushing 16 shown in FIG. 2. Further, pneumatic couplers are available in brass and other electrically conductive materials to provide good electrical continuity so as to complete the circuit. Importantly, pneumatic couplers contain an electrically conductive, positive engagement Internal Latch 19, allowing the Male and Female Couplers 7*b* and 7*a* to be connected or disconnected quickly as described below. Internal Latch 19 typically consists of 3 ball bearings evenly spaced around the circumference of Female Coupler 7*a*. FIG. 3 shows, for illustration purposes, only one of the 3 ball bearings comprising Internal Latch 19.

Operation

Referring to FIG. 2 whereby Connector 7 is in the disengaged position, engagement is accomplished by sliding Female Coupler 7*a* onto Male Coupler 7*b* while a user holds Knurled Ring 11 against Motion Limit Stop 12*a* when Knurled Ring 11 moves in the direction of Arrow 12. As shown in FIG. 3, Spring 20 communicates at one end with Knurled Ring 11 at Spring Stop 21 and Spring 20 communicates at a second end with Female Coupler 7*a* at Spring Stop 22. When Knurled Ring 11 moves along the direction of Arrow 12, Spring 20 compresses and Internal Latch 19 retracts away from Male Coupler 7*b*. Positive engagement of Male Coupler 7*b* occurs when Knurled Ring 11 is released whereby tension in Spring 20 returns Knurled Ring 11 in the opposite direction to that of Arrow 12, home against Flange 13 and Internal Latch 19 is forced to engage into Groove 14 of Male Coupler 7*b*. Disengagement of Male Coupler 7*b* from Female Coupler 7*a* is accomplished simply by moving Knurled Ring 11 in the direction of Arrow 12 and pulling on Male Coupler 7*b*. As Internal Latch 19 releases, Male Coupler 7*b* will easily and quickly separate axially from Female Coupler 7*a* thereby breaking the Conducting Cable 4 connection to ground. Once disengaged, a user must ensure the end of Connector 7 on Conducting Cable 4 leading back to Storage Battery 2 does not come into stray contact with any conductive portion of the surrounding vehicle. Conducting Cable 4 should consist of an insulated stranded wire cable, and should therefore have inherent stiffness sufficient to support the Female or Male Coupler Assembly 7*a* or 7*b* in suspension to prevent inadvertent contact with any portions of the vehicle.

These and other alternatives, derivatives and substitutions that may become apparent to those skilled in the art without departing from the spirit and principles of the matter disclosed and claimed herein are intended to be encompassed within the scope of the invention.

The embodiments of the invention in which an exclusive property or privilege is claimed are defined as follows:

1. A storage battery cable connector comprising in combination:

an electrical conductor means wherein a first end of said electrical conductor means connects to a terminal of a storage battery and a second end of said electrical conductor means connects to a terminal of a vehicle's ground;

a connector means located within and along said electrical conductor means between said first end and said second end, said connector means consisting of a male and female coupler and a means for latching said male and female couplers to avoid inadvertent decoupling from impact or shock;

whereby said means for latching comprises a groove circumferentially disposed about said male couplers, a slidable ring disposed about said female coupler and compressed against said female coupler's end with spring means, said slidable ring on said female coupler, manually operable upon a means to engage and disengage said groove within said male coupler, whereby said means for latching must be manually operated to interrupt the electrical and mechanical connection of said electrical conductor means.

2. The storage battery cable connector of claim 1 wherein said connector means is reconnectable to restore said electrical conductor means.

3. The storage battery cable connector of claim 1 wherein said male and female couplers of said connector means comprises male and female couplers of a pneumatic coupler, said pneumatic coupler electrically and mechanically secured to said electrical conductor means so as to provide a continuous circuit when connected.

4. The device of claim 1 wherein said manually operable means to engage and disengage said groove consists of said slidable ring urged against at least two ball bearings retractably disposed within said female coupler.

* * * * *